US006252359B1

(12) United States Patent
Takagishi

(10) Patent No.: US 6,252,359 B1
(45) Date of Patent: Jun. 26, 2001

(54) DEFLECTION APPARATUS

(75) Inventor: Toshiya Takagishi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/520,157

(22) Filed: Mar. 7, 2000

(30) Foreign Application Priority Data

Mar. 10, 1999 (JP) ..... 11-064041
Jan. 27, 2000 (JP) ..... 12-019328

(51) Int. Cl.[7] ..... G09G 1/04
(52) U.S. Cl. ..... 315/368.28; 315/368.25
(58) Field of Search ..... 315/368.28, 368.11, 315/368.25, 370; 335/213; 313/412

(56) References Cited

U.S. PATENT DOCUMENTS 5,070,280 * 12/1991 Okuyama et al. ..... 315/368.11
5,086,259 * 2/1992 Sakurai et al. ..... 315/368.25
5,793,165 * 8/1998 Hayashi et al. ..... 315/370

* cited by examiner

*Primary Examiner*—Don Wong
*Assistant Examiner*—James Clinger
(74) *Attorney, Agent, or Firm*—Ronald P. Kananen; Rader, Fishman & Grauer

(57) ABSTRACT

The present invention is intended to provide a deflection apparatus which is able to effect an excellent convergence correction by improving an interference between a coma aberration correction coil and a convergence correction coil. In the deflection apparatus according to the present invention, a circuit comprising a coma aberration correction coil, resistors and a reactance means is connected to a vertical deflection coil in series. In the above-mentioned circuit, coil pair comprising the coma aberration correction coil are connected in series. One end of the reactance means is connected to a junction, i.e. middle point of the coil pair. One ends of the respective resistors are connected across the respective ends of the coil pair connected in series. Remaining one ends of those resistors are connected to a remaining one end of the reactance means. The above-described circuit further includes convergence correction coil attached thereto so as to have the coma aberration correction coils and the cores in common. Although an induced current is generated in the coil pair by an interference between the coma aberration correction coils and the convergence correction coil, the reactance means acts on the deflection apparatus so as to reduce the resultant induced current.

4 Claims, 6 Drawing Sheets

DEFLECTION APPARATUS

BACKGROUND OF THE INVENTION

1. Field of the Invention

The present invention relates to a deflection apparatus for use with a color cathode-ray tube, and more particularly to a deflection apparatus which is able to correct a convergence satisfactorily by improving an interference between a coma aberration correction coil and a convergence correction coil.

2. Description of the Related Art

FIG. 1 of the accompanying drawings is a side view showing a structure of a cathode-ray tube having a deflection apparatus according to the related art. In a display apparatus using a cathode-ray tube, a deflection yoke 22 is disposed in a funnel portion 21 B of a cathode-ray tube 21 as shown in FIG. 1.

The deflection coil 22 comprises an annular core 23, a horizontal deflection coil (not shown), a vertical deflection coil (not shown), or the like.

An inline type electron gun 24 is attached to a neck portion 21A of the cathode-ray tube 21. The inline type electron gun 24 emits three electron beams for displaying red (R), green (G) and blue (B) colors.

The circuit provided in the display apparatus may cause a sawtooth current of a horizontal deflection period to flow through a horizontal deflection coil and may cause a sawtooth current of a vertical deflection period to flow through a vertical deflection coil.

The electron beams may be deflected in the horizontal direction by the horizontal deflection coil and may be deflected in the vertical direction by the vertical deflection coil. Thus, the electron beams may scan a phosphor screen 27 and an image is displayed by resultant light.

Generally, the vertical deflection coil is designed so as to generate a barrel-shaped vertical deflection magnetic field. The barrel-shaped magnetic field has a nature such that its magnetic field becomes strong in the starting point or the ending point of a magnetic line of force. The cathode-ray tube having the inline-type electron gun may be generally designed such that a center electron beam may be used to display green color and left and right electron beams may be used to display blue and red colors.

As shown in FIG. 2, in the barrel-shaped vertical deflection magnetic field, blue display and red display electron beams may be strongly affected in the vertical direction as compared with the green display electron beam. In other words, the center electron beam may have a vertical deflection amount smaller than those of the left and right electron beams. As a consequence, the upper and lower areas of the green raster may become slightly smaller than those of the red and blue rasters. This phenomenon can be understood such that the deflection amounts of three electron beams may become different due to a coma aberration.

In order to solve the problem of the above-mentioned phenomenon, there may be used a coil which might be called a coma aberration correction coil.

As shown in FIG. 1, a coma aberration correction coil 25 may be attached to the rear portion of the deflection yoke 22.

Alternatively, as shown in FIG. 4, the coma aberration correction coil 25 comprises C-shaped cores 26 and 26' symmetrically disposed in the upper and lower direction and coils 27 and 27' wound around the C-shaped cores 26 and 26'.

As shown in FIG. 5, the coma aberration correction coil 25 may be connected to the vertical deflection coil in series.

Accordingly, a vertical deflection current flows through the coma aberration coil 25. A magnetic field generated from the coma aberration correction coil 25 may become a dipole magnetic field shown in FIG. 6. This dipole magnetic field may achieve effects which can cancel a coma aberration caused by the influence of the vertical deflection magnetic field.

Further, in FIG. 5, by changing a balance of amounts of currents flowing through the coils 27 and 27', it is possible to correct a misconvergence of a pattern shown in FIG. 7. To this end, there may be frequently used a means, such as a resistor 28 shown in FIG. 5, for changing a balance of amounts of currents flowing through the coils 27 and 27'. However, the above-mentioned method may be unable to correct a misconvergence of a pattern different from that shown in FIG. 7. Therefore, a misconvergence may be corrected by using another coil different from the coma aberration correction coil.

In this case, another coil, i.e., a convergence correction coil, also is disposed at the rear portion of the annular core 23, i.e. the electron gun 24 side. Misconvergences of various patterns can be corrected by causing a parabola current of a deflection period, or the like, to flow through the convergence correction coil.

However, in order to simply the structure of the deflection apparatus, the convergence correction coil may be attached so as to use the cores 27, 27' in common. In this case, a magnetic coupling between the coma aberration correction coil 25 and the convergence correction coil may be strengthened. Thus, when the parabola current or the like flows through the convergence correction coil, the induced current occurs in the coma aberration correction coil. Consequently, there arises such a problem that a correction effect achieved by the convergence correction coil will be decreased unavoidably.

SUMMARY OF THE INVENTION

It is an object of the present invention to provide a deflection apparatus which is able to satisfactorily correct a convergence by improving an interference between a coma aberration correction coil and a convergence correction coil.

In a deflection apparatus according to the present invention, a circuit comprising a coma aberration correction coil, resistors and a reactance means is connected to a vertical deflection coil in series. In the above-described circuit, a coil pair comprising the coma aberration correction coil are connected in series. One end of the reactance means is connected to a junction, i.e., a middle point of the coil pair. One ends of the resistors are connected to respective ends of the coil pair connected in series. Remaining one ends of these resistors are connected to the remaining one end of the reactance means. Further, the above-described circuit includes a convergence correction coil attached thereto so as to use the core of the coma aberration correction coil in common.

According to the above-described arrangement, the current amount of the induced current produced in the coma aberration correction coil can be decreased by the reactance means connected to the middle point between the coil pair. Therefore, the convergence correction coil can achieve satisfactory correction effects.

DESCRIPTION OF THE PREFERRED EMBODIMENT

Now, a deflection apparatus for cathode-ray tube according to an embodiment of the present invention will be described below with reference to the drawings.

Figure 8:
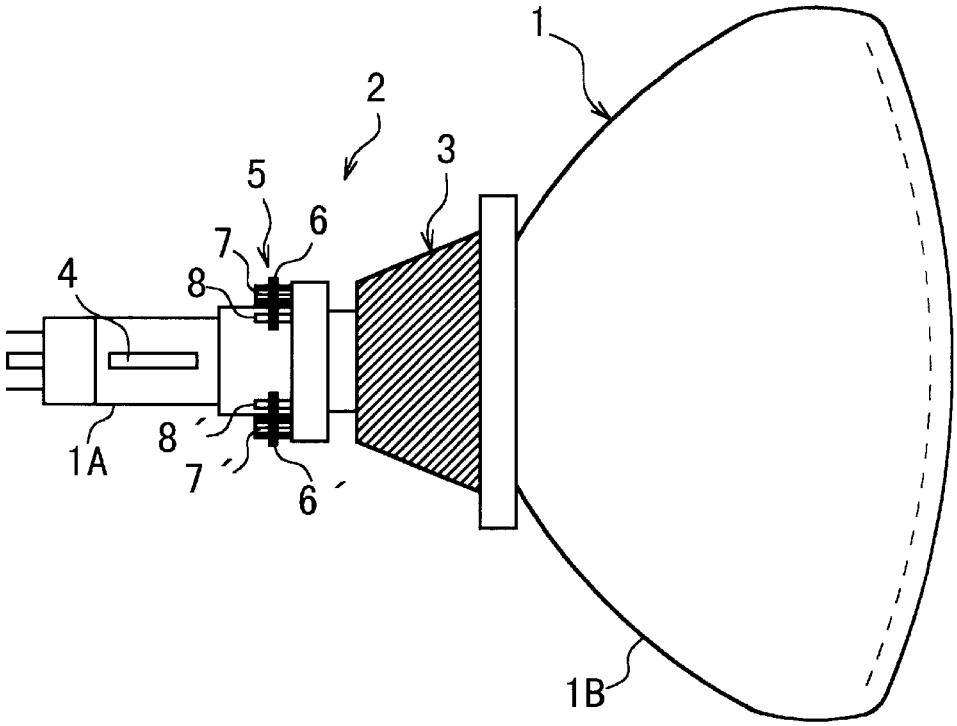
FIG. 8 is a side view illustrating a cathode-ray tube apparatus having a deflection apparatus according to an embodiment of the present invention.

FIG. 8 is a side view showing a cathode-ray tube having a deflection apparatus according to an embodiment of the present invention.

As shown in FIG. 8, a deflection apparatus according to the present invention may comprise a deflection yoke 2, a coma aberration correction coil 5 disposed at the rear end portion of the deflection yoke 2, convergence correction coils 8, 8', and the like.

As shown in FIG. 8, the deflection yoke 2 may comprise a core 3, a horizontal deflection coil (not shown), a vertical deflection coil (not shown), or the like.

A sawtooth current of a horizontal deflection period may flow through the horizontal deflection coil, and a sawtooth current of a vertical deflection period may flow through the vertical deflection coil.

Three electron beams emitted from an electron gun 4 may be deflected by magnetic fields generated from the horizontal and vertical deflection coils in the horizontal and vertical directions.

Figure 9:
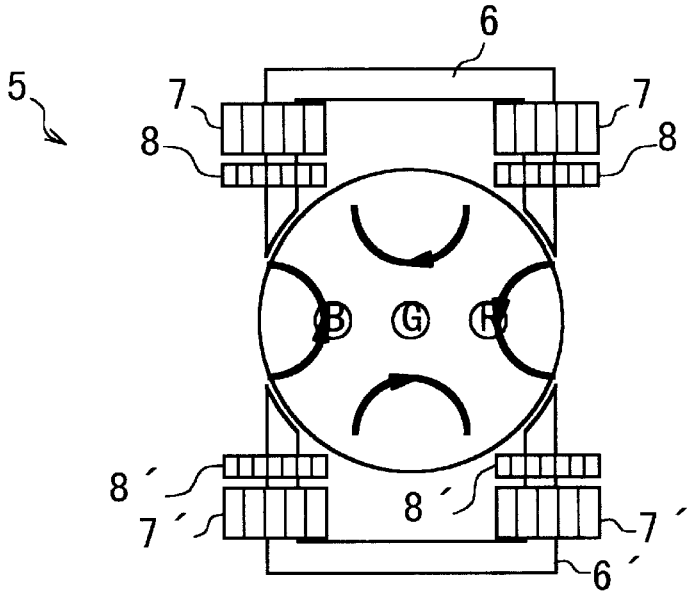
FIG. 9 is a diagram showing the cross-section of the rear portion of the deflection apparatus according to the present invention and shows the layout of coils, cores and magnetic fields generated from the convergence coil.

As shown in FIG. 9, the coma aberration correction coil 5 may comprise upper and lower C-shaped cores 6 and 6' which may be disposed symmetrically and coils 7 and 7' wound around the cores 6 and 6'. Convergence correction coils 8, 8' may be wound around four tip end portions of the cores 6, 6'. The manner in which the coma aberration correction coil 5, the cores 6, 6', the coils 7, 7', the convergence correction coils 8, 8', or the like are connected will be described below.

Figure 10:
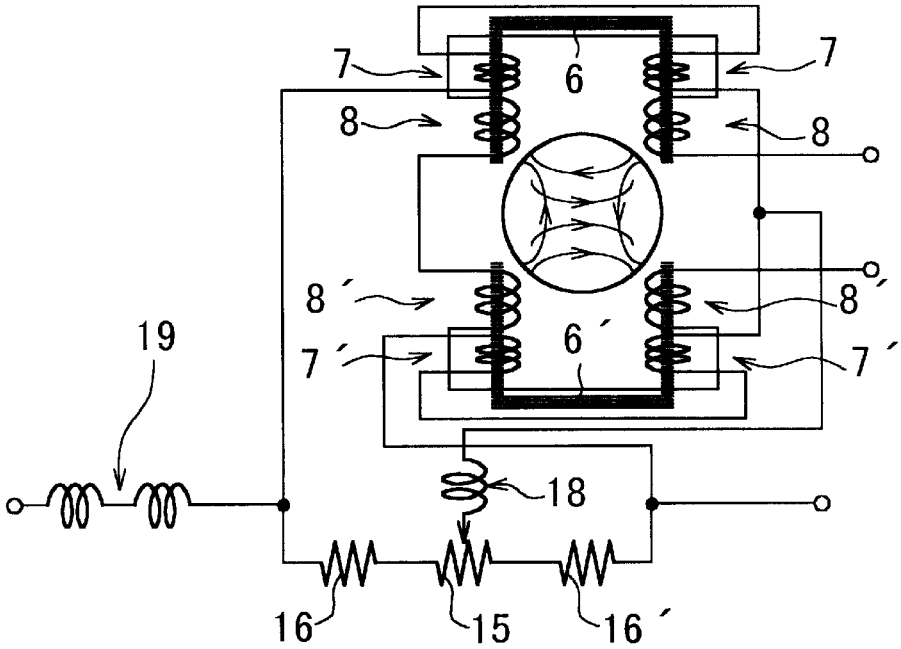
FIG. 10 is a circuit diagram to which reference will be made in explaining the embodiment of the present invention and shows an arrangement in which a reactance means is connected to a middle point between coil pair comprising a coma aberration correction coil.

As shown in FIG. 10, the coils 7 and 7' may be connected in series, and one end of a reactance 18 may be connected to a junction between the coils 7 and 7'. One ends of each of a pair of fixed resistors 16, 16' may be attached to respective ends of the coils 7 and 7' which may be connected in series. A variable resistor 15 may be attached to the remaining ends of the fixed resistors 16, 16'. The fixed resistors 16, 16' may be used to prevent an excess current from flowing even when the resistance value of the variable resistor 15 becomes extremely small after the variable resistor 15 has been adjusted to the maximum. A sliding contact of the variable resistor 15 and the remaining end of the reactance 18 may be connected to each other. Then, the above-described circuit may be connected to the vertical deflection coil.

Figure 11:
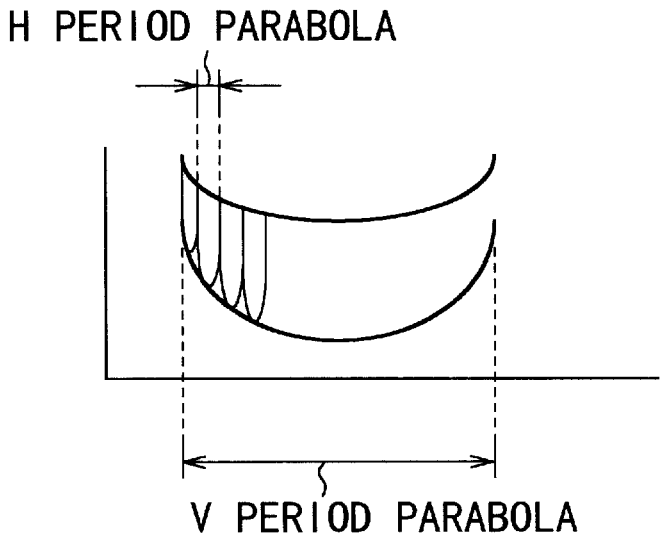
FIG. 11 is a diagram showing an example of a waveform of a current applied to the convergence correction coil and illustrates a parabolic waveform which changes at every horizontal and vertical deflection periods.
Figure 12:
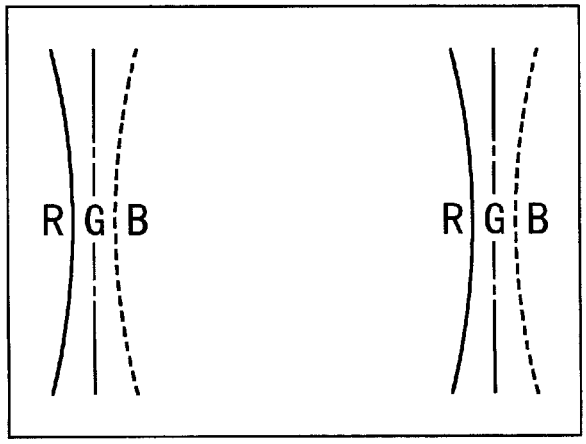
FIG. 12 is a diagram showing a pattern of a misconvergence corrected when the current shown in FIG. 11 flows through the convergence correction coil.

On the other hand, the convergence correction coils 8, 8' may be connected in series. Then, when a current flows through the convergence correction coils 8, 8', the convergence correction coils 8, 8' generate a quadrupole magnetic field shown in FIG. 9. That is, magnetic fields of opposite directions may act on the electron beam for displaying blue color and the electron beam for displaying red color, respectively. When the magnetic fields of polarities shown in FIG. 9 act on the electron beam for displaying blue color and the electron beam for displaying red color, the blue electron beam may be affected by a force directed in the right-hand side in FIG. 9 and the red electron beam may be affected by a force directed in the left-hand side in FIG. 9. The directions and magnitudes of the above-mentioned force are adapted to change in response the direction and magnitude of the current which flows through the convergence correction coils 8, 8'. When a current having a waveform shown in FIG. 11, for example, flows through the coils 8, 8', there may be corrected a misconvergence of pattern shown in FIG. 12. That is, it is possible to correct misconvergence with a variety of patterns by adjusting the waveform of current which changes at every horizontal deflection period and at every vertical deflection period.

The manner in which the coma aberration correction coil 5 and the convergence correction coils 8, 8' interfere with each other will be described next.

In the above-mentioned structure, the coils 7, 7' and the convergence correction coils 8, 8' may be wound around the common cores 6, 6'. Therefore, induced currents may be generated in the coils 7, 7' in accordance with the change of magnetic fields generated from the convergence correction coils 8, 8'.

As is clear from the electromagnetic induction rule, these induced currents may generate magnetic fields which may cancel the magnetic fields generated from the convergence correction coils 8, 8' with each other. Accordingly, magnetic fields generated from the convergence correction coils 8, 8' may be canceled much more with each other as the current amount of the induced current increases. In this case, in FIG.

10, induced currents may independently flow through two closed circuits.

One of the two closed circuits may be a closed circuit comprising the coil 7, the fixed resistor 16, the variable resistor 15 and the reactance 18. The other closed circuit may comprise the coil 7', the fixed resistor 16', the variable resistor 15 and the reactance 18.

In the embodiment of the present invention, the reactance 18 may be included in the two closed circuits. This reactance 18 may be effective for suppressing the induced currents generated in the coils 7, 7'.

A vertical deflection current may flow through the coma aberration correction coil 5, and the frequency of this vertical deflection current may fall within a range of from 50 to 100 Hz. However, as earlier described, the current which changes at every horizontal deflection period may flow through the convergence correction coils 8, 8'. The horizontal deflection period may be generally higher than 15 kHz, which may be a high frequency as compared with that of the vertical deflection period. Therefore, the reactance 18 may act on this induced current as a high impedance and may act on the vertical deflection current as a low impedance. The current amount of the induced current which may flow through the two closed circuits may decrease since the reactance 18 may act on the induced current as the high impedance. As a result, the magnetic field generated by the induced current may decrease.

Figure 1:
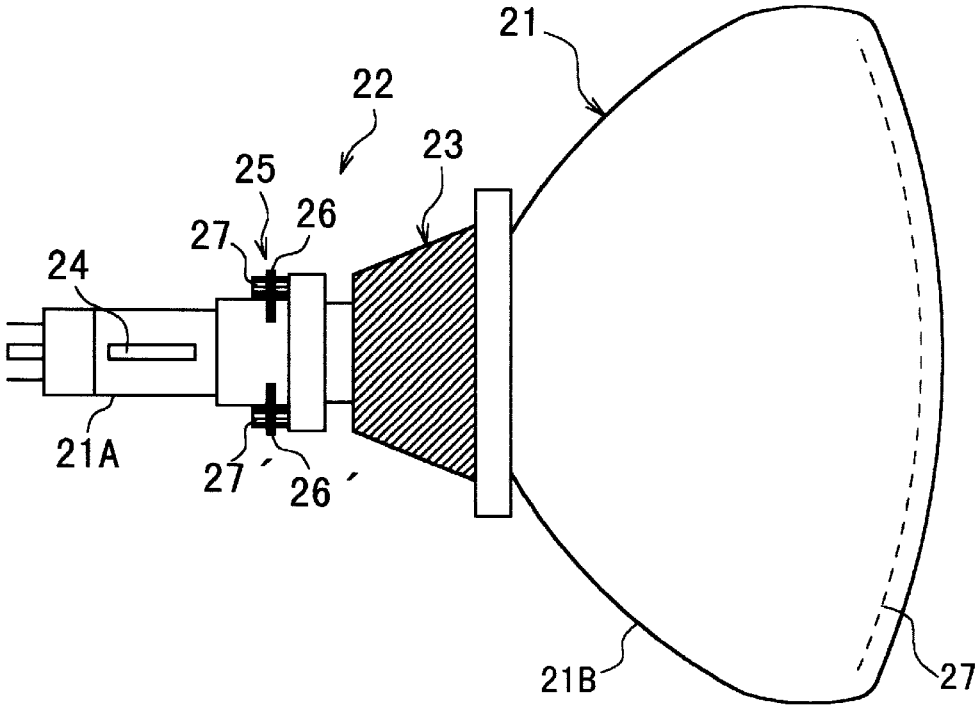
FIG. 1 (RELATED ART)
FIG. 1 is a side view illustrating a structure of a cathode-ray tube apparatus having a deflection apparatus according to the prior art.
Figure 2:
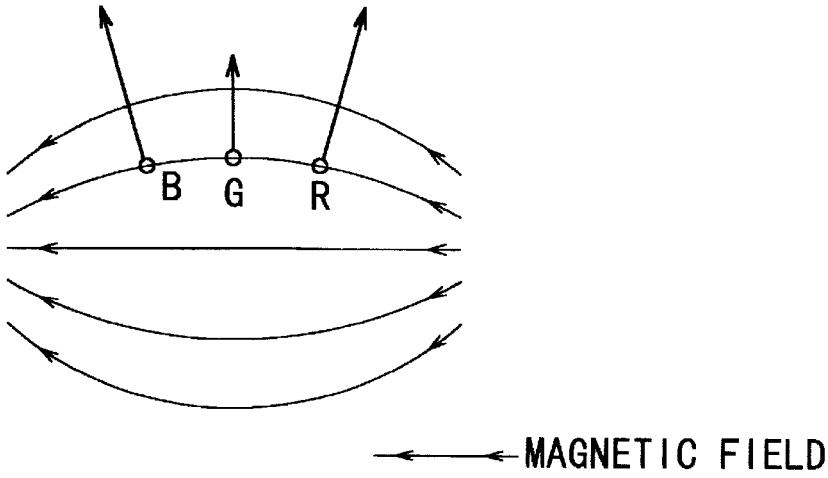
FIG. 2 is a top view illustrating the cross-section of a cathode-ray tube from a phosphor screen side when electron beams are deflected in the upper vertical direction and shows the state in which side beams are strongly affected by barrel-shaped vertical deflection magnetic fields.
Figure 3:
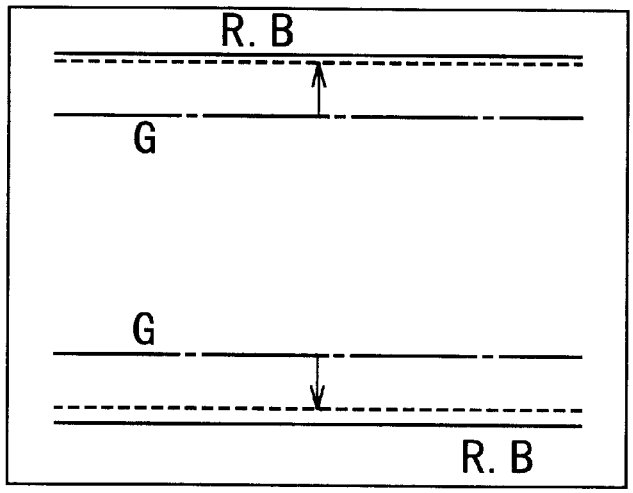
FIG. 3 is a diagram to which reference will be made in explaining the state in which positional displacements occur at upper and lower end portions of the rasters on the screen when a difference of deflected amounts occurs in three electron beams.
Figure 4:
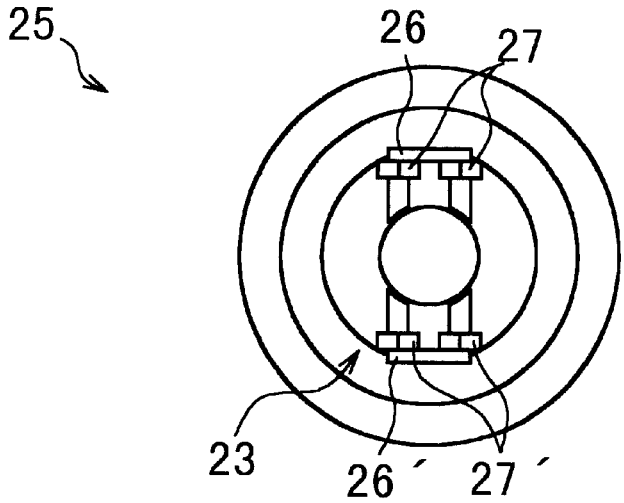
FIG. 4 is a rear view illustrating the conventional deflection apparatus from the neck portion side of the cathode-ray tube.
Figure 5:
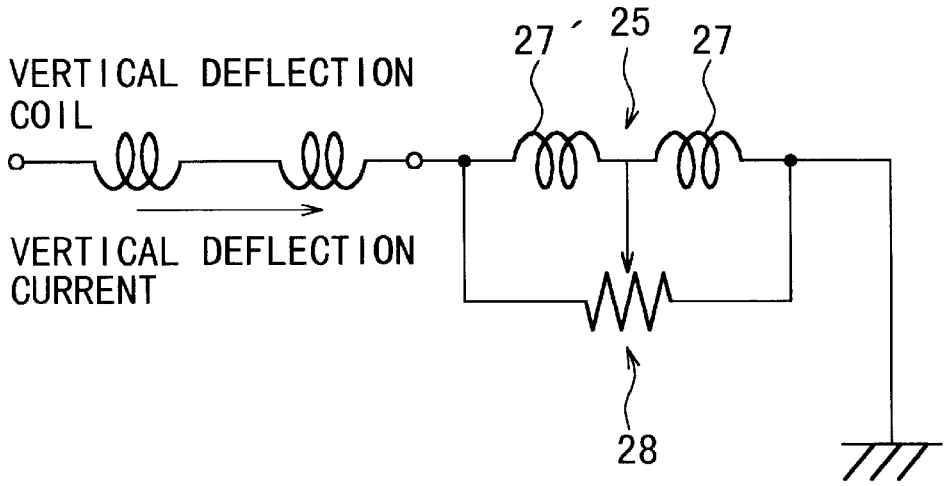
FIG. 5 is a circuit diagram showing a circuit arrangement in which a coma aberration correction coil connected to a resistor in parallel is connected in series to a vertical deflection coil of a deflection apparatus.
Figure 6:
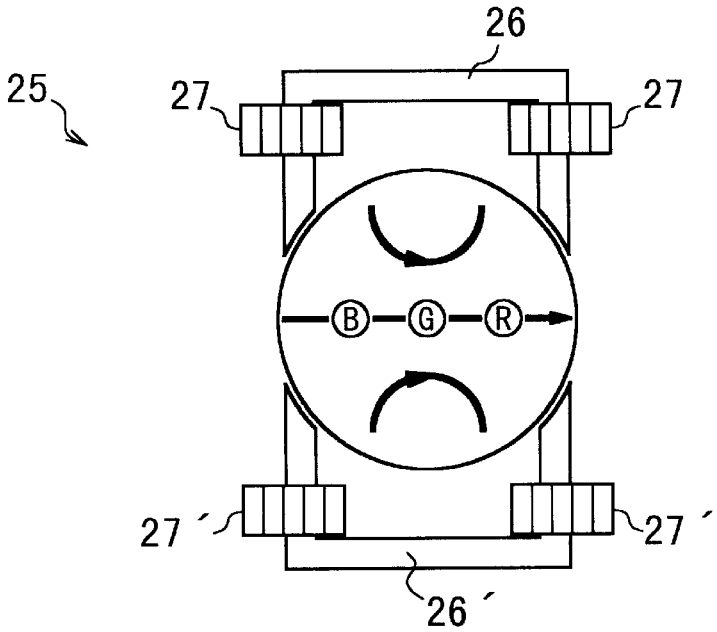
FIG. 6 is a cross-sectional view illustrating the cross-section of the rear portion of the deflection apparatus from the screen side of the cathode-ray tube and shows the layout of coils, cores and magnetic fields.
Figure 7:
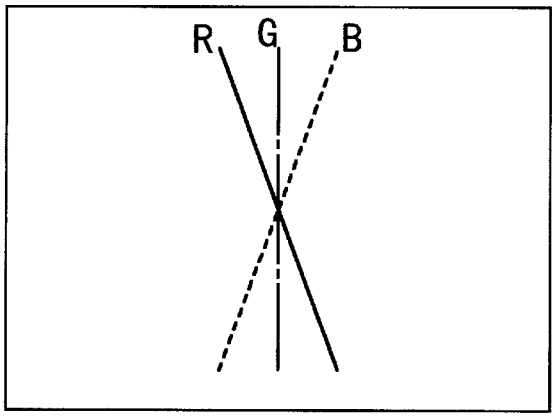
FIG. 7 is a diagram showing a pattern of a misconvergence observed on the screen of the cathode-ray tube when electron beams and vertical deflection magnetic fields are positionallly displaced in the upper and lower direction.

When on the other hand the variable resistor 15 may be adjusted in order to correct the misconvergence pattern shown in FIG. 7, a part of vertical deflection current may flow through the reactance 18. In this case, since the reactance 18 may act on the vertical deflection current as the low impedance, the reactance 18 may not affect the magnitude of the flowing current substantially. That is, the misconvergence can be corrected in substantially the same degree as that of the related art.

As set forth above, according to the present invention, the current amount of induced current generated in the coils 7, 7' can be decreased without exerting a bad influence upon the convergence correction. Therefore, it is possible to solve the problem of reduction of the correction effect achieved by the convergence correction coil.

Furthermore, since the coma aberration correction coil and the convergence correction coil may use the common core, it is possible to provide an inexpensive deflection apparatus which can be simplified in structure.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. A deflection apparatus for a color cathode-ray tube comprising:

a horizontal deflection coil;

a vertical deflection coil;

an annular core surrounding said horizontal deflection coil and said vertical deflection coil;

upper and lower cores disposed symmetrically on said annular core on the side of an electron gun;

a first coil would around on said upper core;

a second coil wound around on said lower coil;

a third coil wound around on said upper core; and a fourth coil wound around on said lower core, wherein said first coil and said second coil are connected in series so as to generate a dipole magnetic field, said first coil and said second coil connected in series are connected to said vertical deflection coil in series, one end of a reactance means is connected to a junctions between said first soil and said second coil, resistors are connected across both ends of said first coil and said second coil connected in series, a middle point between said resistors is connected to the other end of said reactance means, and said third coil and said fourth coil are connected so as to generate a quadruple magnetic pole.

2. A deflection apparatus as claimed in claim 1, wherein a ratio between currents flowing through said first coil and said second coil is changed by changing a ratio of resistance values with respect to the middle point of said resistors.

3. A deflection apparatus as claimed in claim 2, wherein said ratio of resistance values is changed by using a variable resistor.

4. A deflection apparatus as claimed in claim 2, wherein said variable resistor has a slidable contact connected as a middle point of said resistors.

* * * * *

UNITED STATES PATENT AND TRADEMARK OFFICE

CERTIFICATE OF CORRECTION

PATENT NO. : 6,252,359 B1
DATED : June 26, 2001
INVENTOR(S) : Toshiya Takagishi

It is certified that error appears in the above-identified patent and that said Letters Patent is hereby corrected as shown below:

Title page,
Item [30], Foreign Application Priority Data, 2nd application, "12-019328" should read -- 2000-019328 --.

Column 6,
Line 17, "would" should read -- wound --.
Line 25, "junctions" should read -- junction --.

Signed and Sealed this

Twenty-second Day of July, 2003

JAMES E. ROGAN
*Director of the United States Patent and Trademark Office*